US009828197B2

(12) United States Patent
Hashimoto

(10) Patent No.: US 9,828,197 B2
(45) Date of Patent: Nov. 28, 2017

(54) IMAGE FORMING APPARATUS

(71) Applicant: Brother Kogyo Kabushiki Kaisha, Nagoya-shi, Aichi-ken (JP)

(72) Inventor: Yohei Hashimoto, Nagakute (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/364,382

(22) Filed: Nov. 30, 2016

(65) Prior Publication Data

US 2017/0152116 A1 Jun. 1, 2017

(30) Foreign Application Priority Data

Nov. 30, 2015 (JP) ..... 2015-233406

(51) Int. Cl.
*B65H 3/06* (2006.01)
*G03G 15/00* (2006.01)

(52) U.S. Cl.
CPC ..... *B65H 3/0669* (2013.01); *B65H 3/0684* (2013.01); *G03G 15/6529* (2013.01); *B65H 2403/421* (2013.01); *B65H 2403/481* (2013.01); *B65H 2801/12* (2013.01)

(58) Field of Classification Search
CPC ..... B65H 3/0669; B65H 3/0684; B65H 2403/421; B65H 2403/481; B65H 2403/722
See application file for complete search history.

(56) References Cited

U.S. PATENT DOCUMENTS

| | | | | |
|---|---|---|---|---|
| 7,461,840 | B2 | 12/2008 | Hattori | |
| 7,931,265 | B2 | 4/2011 | Okamoto | |
| 8,224,229 | B2 | 7/2012 | Okamoto | |
| 8,276,906 | B2 | 10/2012 | Yamamoto | |
| 8,540,234 | B2 | 9/2013 | Akatsuka et al. | |
| 8,596,636 | B2 | 12/2013 | Ichikawa et al. | |
| 8,708,331 | B2 | 4/2014 | Ueyama | |
| 8,800,986 | B2 * | 8/2014 | Tomatsu | 271/126 |
| 2006/0180986 | A1 | 8/2006 | Hattori | |
| 2009/0200729 | A1 | 8/2009 | Okamoto | |

(Continued)

FOREIGN PATENT DOCUMENTS

| | | |
|---|---|---|
| JP | 2006-176321 A | 7/2006 |
| JP | 2008-174390 A | 7/2008 |

(Continued)

*Primary Examiner* — Luis A Gonzalez
(74) *Attorney, Agent, or Firm* — Banner & Witcoff, Ltd.

(57) ABSTRACT

An image forming apparatus includes a support portion configured to support a sheet, a roller configured to feed the sheet supported on the support portion, a separation member configured to apply a feeding resistance to the sheet fed by the roller from the support portion, a holder holding the roller, a holder pivoting member configured to pivot the holder between a first position where the roller contacts the sheet and a second position where the roller is separated from the sheet, a clutch mechanism, a clutch-state changing member, a rotator configured to rotate between an off position where the holder is at the second position and the clutch mechanism is at a cut-off state and an on position where the holder is at the first position and the clutch mechanism is at a transmission state, a stopper configured to stop the rotator, and an actuator connected to the stopper.

11 Claims, 10 Drawing Sheets

(56) References Cited

U.S. PATENT DOCUMENTS

| | | | |
|---|---|---|---|
| 2010/0104311 | A1 | 4/2010 | Okamoto |
| 2011/0024968 | A1 | 2/2011 | Ichikawa et al. |
| 2011/0180985 | A1 | 7/2011 | Yamamoto |
| 2012/0237279 | A1 | 9/2012 | Ichikawa |
| 2013/0134656 | A1 | 5/2013 | Akatsuka et al. |
| 2013/0256979 | A1 | 10/2013 | Ueyama |

FOREIGN PATENT DOCUMENTS

| | | | |
|---|---|---|---|
| JP | 2009-190808 | A | 8/2009 |
| JP | 2010-105768 | A | 5/2010 |
| JP | 2011-032027 | A | 2/2011 |
| JP | 2011-131949 | A | 7/2011 |
| JP | 2011-153014 | A | 8/2011 |
| JP | 2012-188283 | A | 10/2012 |
| JP | 2013-107773 | A | 6/2013 |
| JP | 2013-209192 | A | 10/2013 |

* cited by examiner

DRIVE SOURCE
10
130
150
131B
132B
154
110
125
100
121
120
36P
122
34B
34A
36
112
123
124
160
170

DRIVE SOURCE
10
130
150
131B
132B
110
125
100
121
120
36P
122
34B
34A
36
34S
112
123
124
160
170
REAR
RIGHT
LEFT
FRONT

IMAGE FORMING APPARATUS

CROSS-REFERENCE TO RELATED APPLICATION

This application claims priority from Japanese Patent Application No. 2015-233406 filed on Nov. 30, 2015, the content of which is incorporated herein by reference in its entirety.

FIELD OF DISCLOSURE

The invention relates to an image forming apparatus including a support portion configured to support a sheet, and a roller configured to feed the sheet supported on the support portion.

BACKGROUND

Known image forming apparatuses, e.g. printers, include a support portion for supporting a sheet thereon, e.g. a multi-purpose tray (hereinafter referred to as a MP tray), and a feed roller for feeding the sheet supported on the support portion. A known image forming apparatus is provided with a feed roller, which is pivotable between a position where the feed roller is separated from a sheet on a MP tray and a position where the feed roller contacts the sheet on the MP tray.

The image forming apparatus is structured that, when a solenoid switch (actuator) is turned on upon receipt of a feeding start signal, a sector gear starts to rotate. While the sector gear makes one rotation, the feed roller pivots to the position where the feed roller contacts an upper surface of the sheet on the MP tray, receives a driving force to rotate, feeds sheets on the MP tray, then pivots to the position where the feed roller is separated from the sheet, and the driving force is not applied to the feed roller.

SUMMARY

Illustrative aspects of the disclosure provide an image forming apparatus enabling, through turning on and off of an actuator, a roller to change between a state where the roller contacts a sheet and is driven to rotate and a state where the roller is separated from the sheet and stops rotating.

According to an aspect of the disclosure, an image forming apparatus includes a support portion configured to support a sheet, a roller configured to feed the sheet supported on the support portion, a separation member configured to apply a feeding resistance to the sheet fed by the roller from the support portion, a holder holding the roller, a holder pivoting member, a clutch mechanism, a clutch-state changing member, a rotator, a stopper, and an actuator. The holder is configured to pivot about a pivot axis between a first position where the roller contacts a sheet supported on the support portion and a second position where the roller is separated from the sheet supported on the support portion. The holder pivoting member is configured to pivot about a pivot axis parallel to the pivot axis of the holder and to pivot the holder between the first position and the second position. The clutch mechanism is configured to change between a transmission state that allows transmission of a driving force from a drive source to the roller and a cut-off state that cuts off the transmission of the driving force from the drive source to the roller. The clutch-state changing member is configured to pivot about a pivot axis parallel to the axis of the holder pivoting member to engage the clutch mechanism such that the clutch mechanism is at the transmission state and to disengage from the clutch mechanism such that the clutch mechanism is at the cut-off state. The rotator includes a first cam portion for pivoting the holder pivoting member and a second cam portion for pivoting the clutch-state changing member. The rotator is configured to rotate about a rotational axis parallel to the pivot axis of the clutch-state changing member between an off position where the first cam portion pivots the holder pivoting member to bring the holder at the second position and the second cam portion pivots the clutch switching mechanism to bring the clutch mechanism to the cut-off state and an on position where the first cam portion pivots the holder pivoting member to bring the holder at the first position and the second cam portion pivots the clutch-state changing member to bring the clutch mechanism at the transmission state. The stopper includes a first engaging portion and a second engaging portion. The first engaging portion and the second engaging portion extend in different, respective directions. The stopper is configured to pivot about a pivot axis parallel to the rotational axis of the rotator between a first engagement position where the first engaging portion engages the rotator and a second engagement position where the second engaging portion engages the rotator, the stopper being configured to, when the first engaging portion engages the rotator, stop the rotator at the off position, and configured to, when the second engaging portion engages the rotator, stop the rotator at the on position. The actuator is connected to the stopper and configured to move the stopper between the first engagement position and the second engagement position.

With this structure, turning on and off of the actuator enables the roller to change between a state where the roller contacts the sheet and is driven to rotate and a state where the roller is separated from the sheet and stops rotating.

DETAILED DESCRIPTION

An embodiment of the disclosure will be described with reference to the following drawings.

Figure 1:
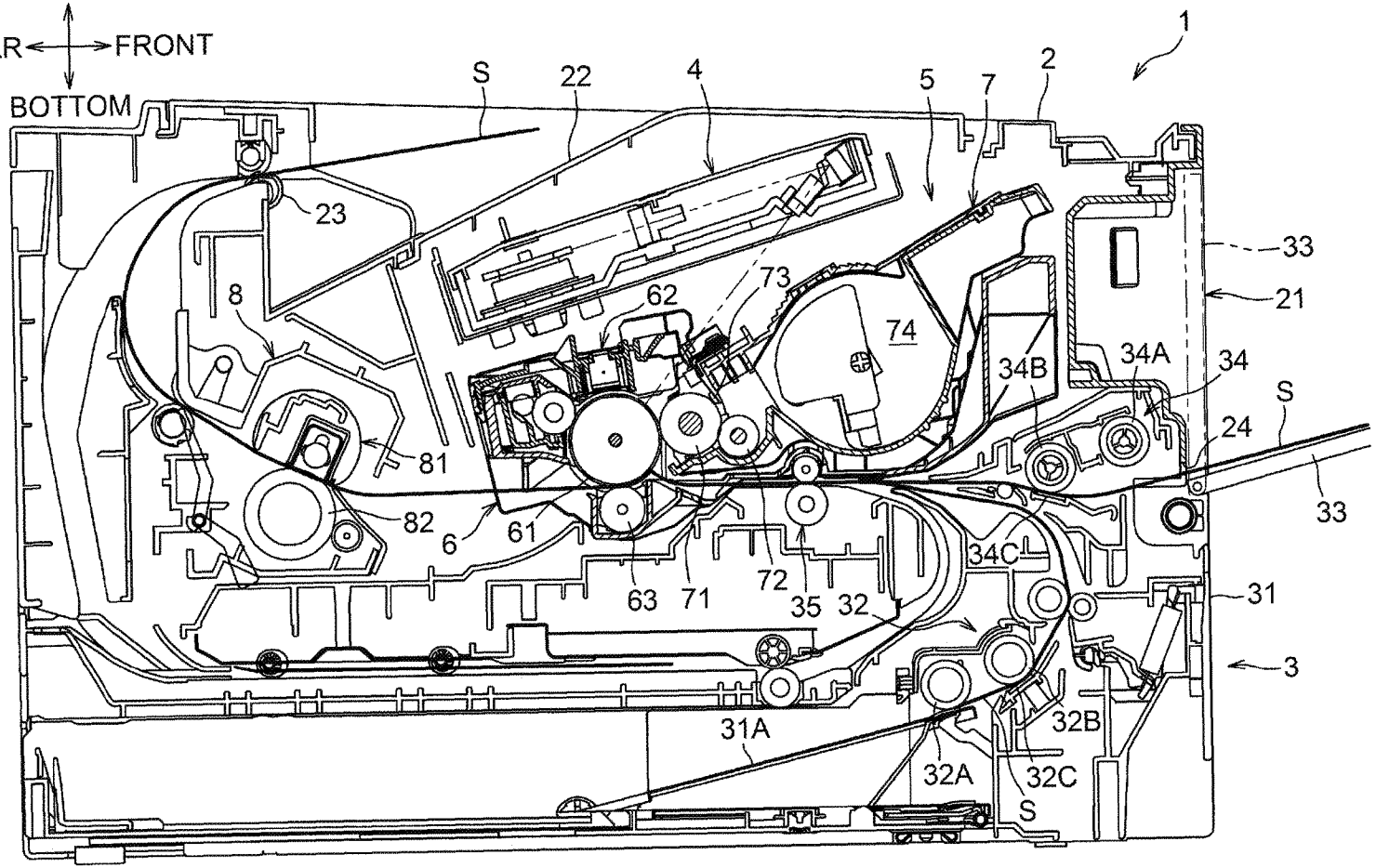
FIG. 1 illustrates a general structure of an image forming apparatus according to an aspect of the invention.

As illustrated in FIG. 1, a laser printer 1, as an example of an image forming apparatus, includes a housing 2, a sheet feeder 3, a light exposure unit 4, a process cartridge 5, and a fixing unit 8.

In the following description, orientations or sides of the laser printer 1 will be identified based on the laser printer 1 disposed in an orientation in which it is intended to be used. In other words, in FIG. 1, the right side is referred to as the front or front side, the left side is referred to as the rear or the rear side, the up side is referred to as the top or upper side, and the down side is referred to as the bottom or lower side.

The sheet feeder 3 is configured to feed a sheet S to the process cartridge 5, and includes a sheet tray 31, a first sheet feeding mechanism 32, a MP tray 33 as an example of a support portion, a second sheet feeding mechanism 34, and a registration roller 35.

The sheet tray 31 is configured to accommodate and support the sheet S and to be attached to and removed from a lower portion of the housing 2.

The first sheet feeding mechanism 32 includes a feed roller 32A, a separation roller 32B, and a separation pad 32C.

The MP tray 33 is configured to support a sheet S thereon, and is pivotally coupled to the housing 2 for moving between a closed position, indicated by a dash-dot-dot line, at which a sheet feed opening 24 defined by the front side of the housing 2 is closed and an open position indicated by a solid line at which the sheet feed opening 24 is open. The MP tray 33 is capable of supporting sheets S thereon when pivoted to the open position at which the opening 24 is open.

The second sheet feeding mechanism 34 includes a feed roller 34A as an example of a roller, a separation roller 34B, and a separation pad 34C as an example of a separation member. The feed roller 34A is a roller for feeding a sheet S supported on the MP tray 33. The separation pad 34C is a member for applying a feeding resistance or frictional resistance to the sheet S fed from the MP tray 33.

Sheets S accommodated in the sheet feed tray 31 are raised to the feed roller 32A by a sheet pressing plate 31A, and fed by the feed roller 32A. The sheets S are separated one by one by the separation roller 32B and the separation pad 32C, and a separated sheet S is fed toward the process cartridge 5 after a skewed feed is corrected by the registration roller 35. Sheets S supported on the MP tray 33 are fed by the feed roller 34A, separated one by one by the separation roller 34B and the separation pad 34C, and a separated sheet S is fed toward the process cartridge 5 after a skew feed is corrected by the registration roller 35.

The light exposure unit 4 is disposed in an upper portion of the housing 2 and includes a light source, which is not illustrated, a polygon mirror, lenses, and reflective mirrors, whose numerals are omitted. The light exposure unit 4 is configured to expose a surface of the photosensitive drum 61 to a laser beam, which is emitted based on image data from the light source and indicated by a dash-dot-dot line, by scanning the surface of the photosensitive drum 61 at high speed.

The process cartridge 5 is disposed below the light exposure unit 4, and configured to be attached to and removed from the housing 2 through an opening defined when a front cover 21, which is coupled to the housing 2, is open. The process cartridge 5 includes a photosensitive unit 6 and a developing unit 7.

The photosensitive unit 6 includes a photosensitive drum 61, a charger 62, and a transfer roller 63. The developing unit 7 is configured to be attached to and removed from the photosensitive unit 6. The developing unit 7 includes a developing roller 71, a supply roller 72, a layer thickness regulating blade 73, and a toner storing portion 74 configured to store developer, e.g., toner, therein.

In the process cartridge 5, the surface of the photosensitive drum 61 is uniformly charged by the charger 62, and then exposed to high-speed scanning laser beam emitted from the light exposure unit 4, and a latent static image based on the image data is formed on the surface of the photosensitive drum 61. Toner stored in the toner storing portion 74 is supplied to the developing roller 71 via the supply roller 72, passes through between the developing roller 71 and the layer thickness regulating blade 73, and is carried on the surface of the developing roller 71 as a thin layer having a constant thickness.

The toner carried on the developing roller 71 is supplied to the electrostatic latent image formed on the photosensitive drum 61. Thus, the electrostatic latent image becomes visible, and a toner image is carried on the surface of the photosensitive drum 61. When a sheet S passes through between the photosensitive drum 61 and the transfer roller 63, the toner image on the photosensitive drum 61 is transferred onto the sheet S.

The fixing unit 8 is disposed behind the process cartridge 5, and includes a heating unit 81 having a halogen heater, a fixing belt, and a nip plate, whose numerals are omitted, and a pressure roller 82. The fixing belt is sandwiched between the nip plate of the heating unit 81 and the pressure roller 82. In the fixing unit 8, the toner image transferred onto the sheet S is thermally fixed when the sheet S passes between the heating unit 81 and the pressure roller 82. The sheet S having the toner image thermally fixed thereon is ejected onto an ejection tray 22 by an ejection roller 23.

Figure 2:
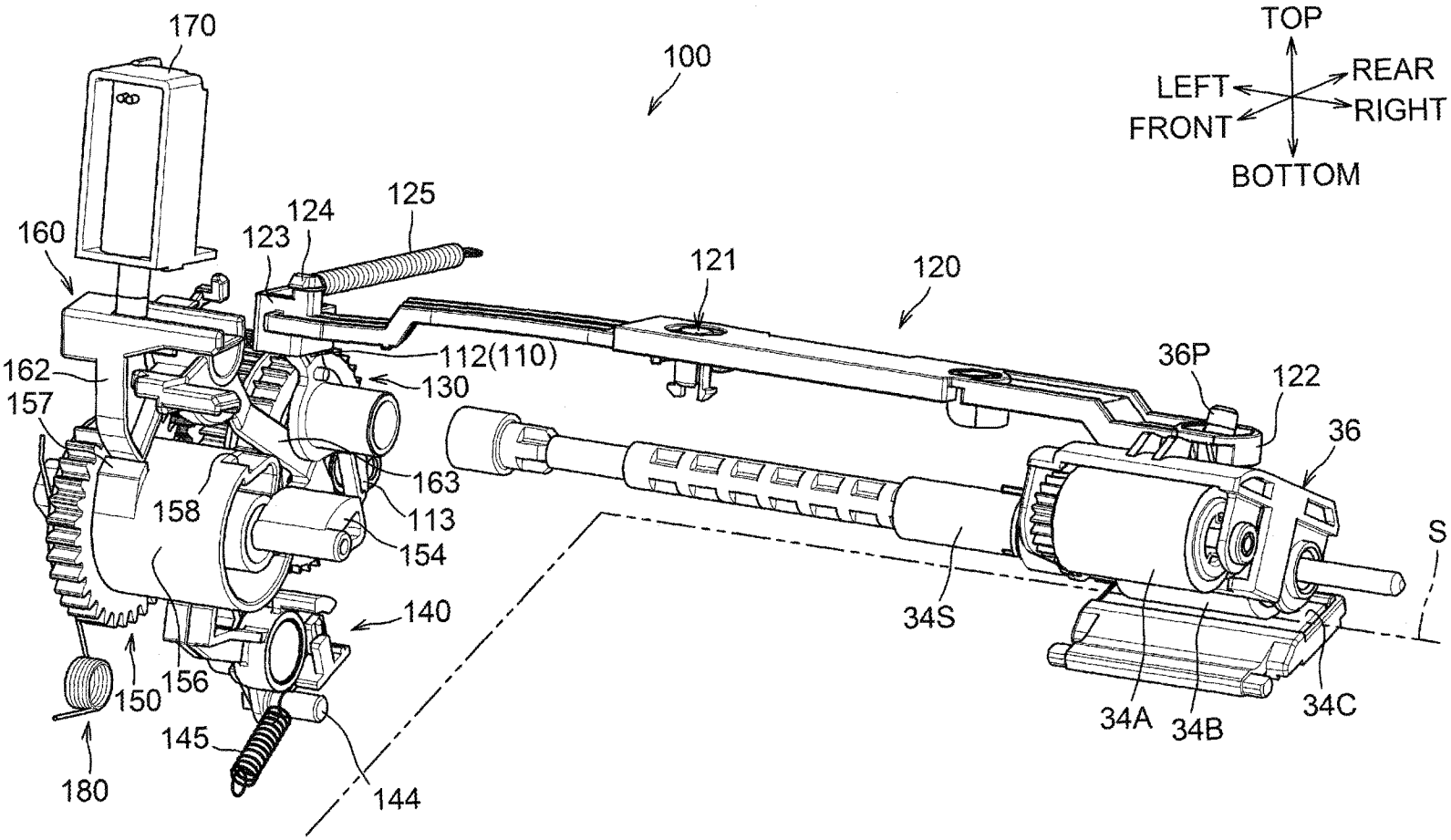
FIG. 2 is a perspective view of a drive mechanism and a holder located in a second position.

As illustrated in FIG. 2, the feed roller 34A and the separation roller 34B are rotatably held by a holder 36. The feed roller 34A is connected to a separation roller shaft 34S via an idle gear (not illustrated) disposed in the holder 36. A separation roller driving gear (not illustrated) is disposed at a left end of the separation roller shaft 34S. The separation roller 34B and the feed roller 34A are configured to rotate when a drive force from a drive source 10 (FIG. 5), such as a motor disposed in the housing 2, is transmitted to the separation roller driving gear disposed at the separation roller shaft 34S via a clutch gear assembly 130 and idle gears, which are not illustrated.

Figure 3:
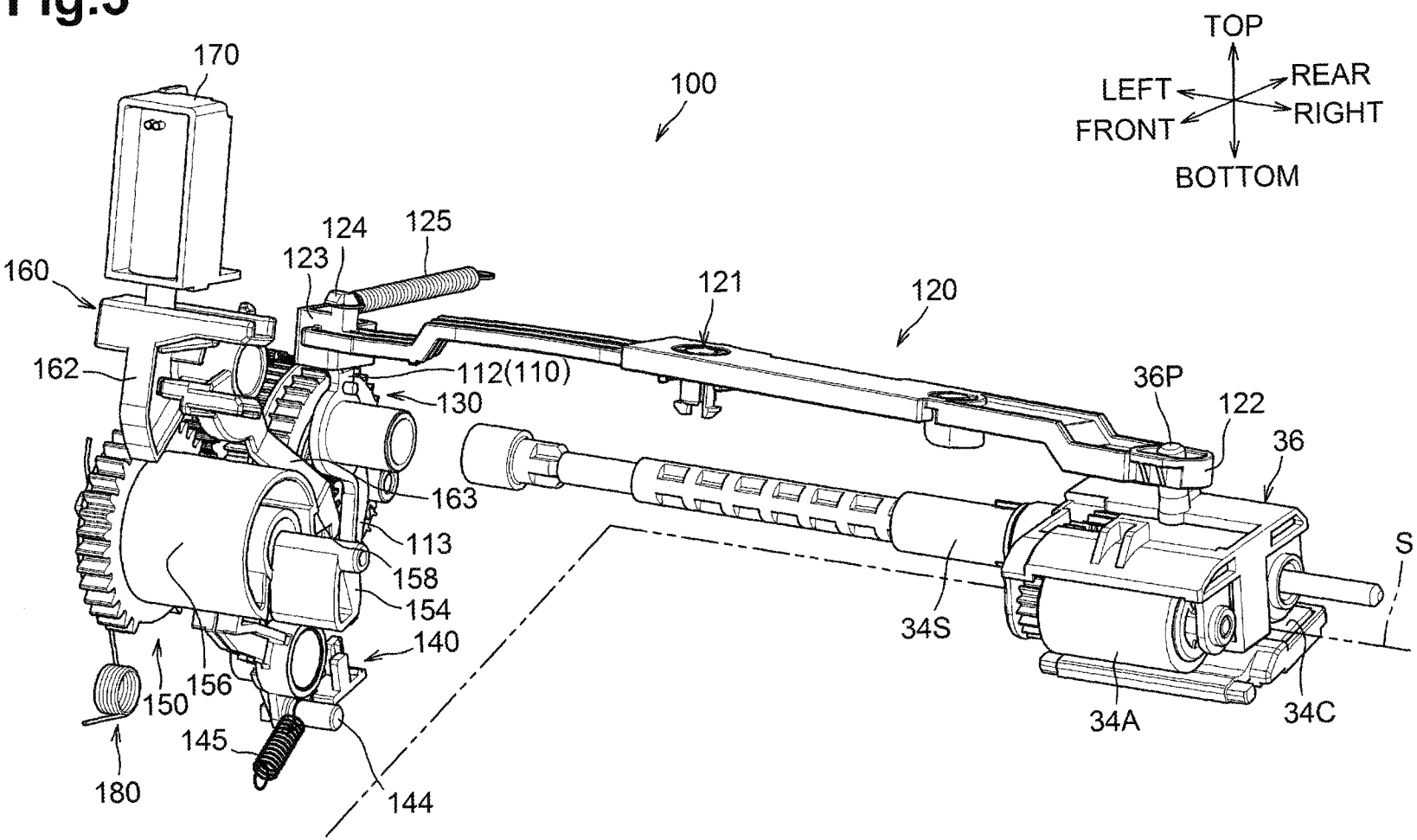
FIG. 3 is a perspective view of the drive mechanism and the holder located in a first position.

The holder 36 is supported by the housing 2 such that it is pivotable about the separation roller shaft 34S with the separation roller 34B being brought in contact with the separation pad 34C. Specifically, the holder 36 is supported such that it is pivotable between a second position illustrated in FIG. 2 and a first position illustrated in FIG. 3. The first position illustrated in FIG. 3 is a roller contact position where the feed roller 34A is brought in contact with an upper surface of a sheet S supported on the MP tray 33. The second position illustrated in FIG. 2 is a roller separation position where the feed roller 34A is pivoted upward from the first position to be separated from a sheet S supported on the MP tray 33.

The following will describe a structure of a drive mechanism 100 configured to pivot the feed roller 34A and transmit a drive force to the feed roller 34A.

Figure 4:
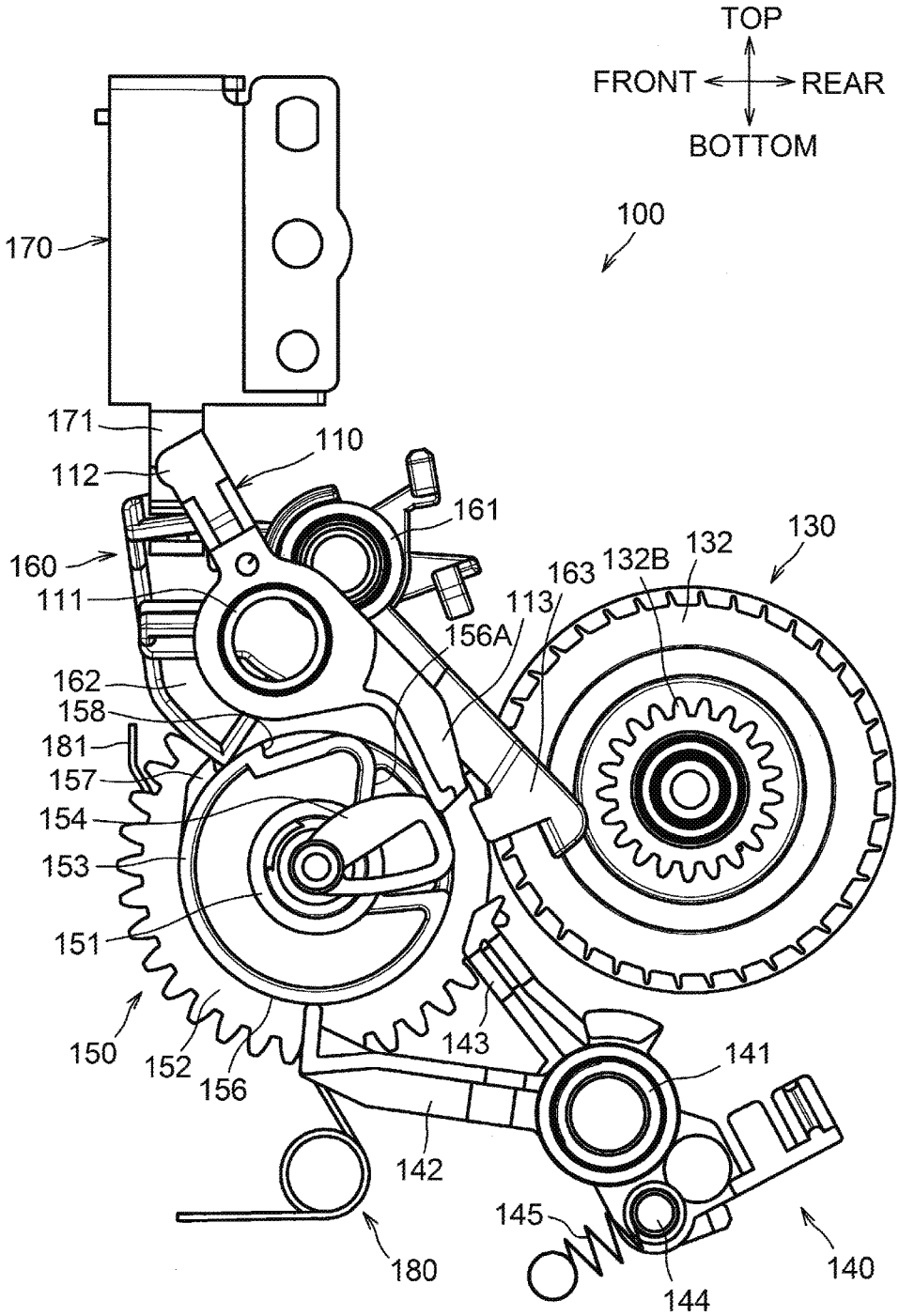
FIG. 4 is a right side view of the drive mechanism.

As illustrated in FIG. 4, the drive mechanism 100 includes a holder pivoting member 110, a link 120 (FIG. 5), a clutch gear assembly 130 as an example of a clutch mechanism, a clutch-state changing member 140, a rotator 150, a stopper 160, an actuator 170, and a torsion spring 180 as an example of an urging member.

The holder pivoting member 110 is supported by the housing 2 such that it is pivotable about a shaft portion 111. The holder pivoting member 110 is configured to act on the link 120 to pivot the holder 36 between the second position and the first position via the link 120. The holder pivoting member 110 includes an upper arm 112 extending substantially upward from the shaft portion 111 and a lower arm 113 extending substantially downward from the shaft portion 111.

Figures 5A, 5B:
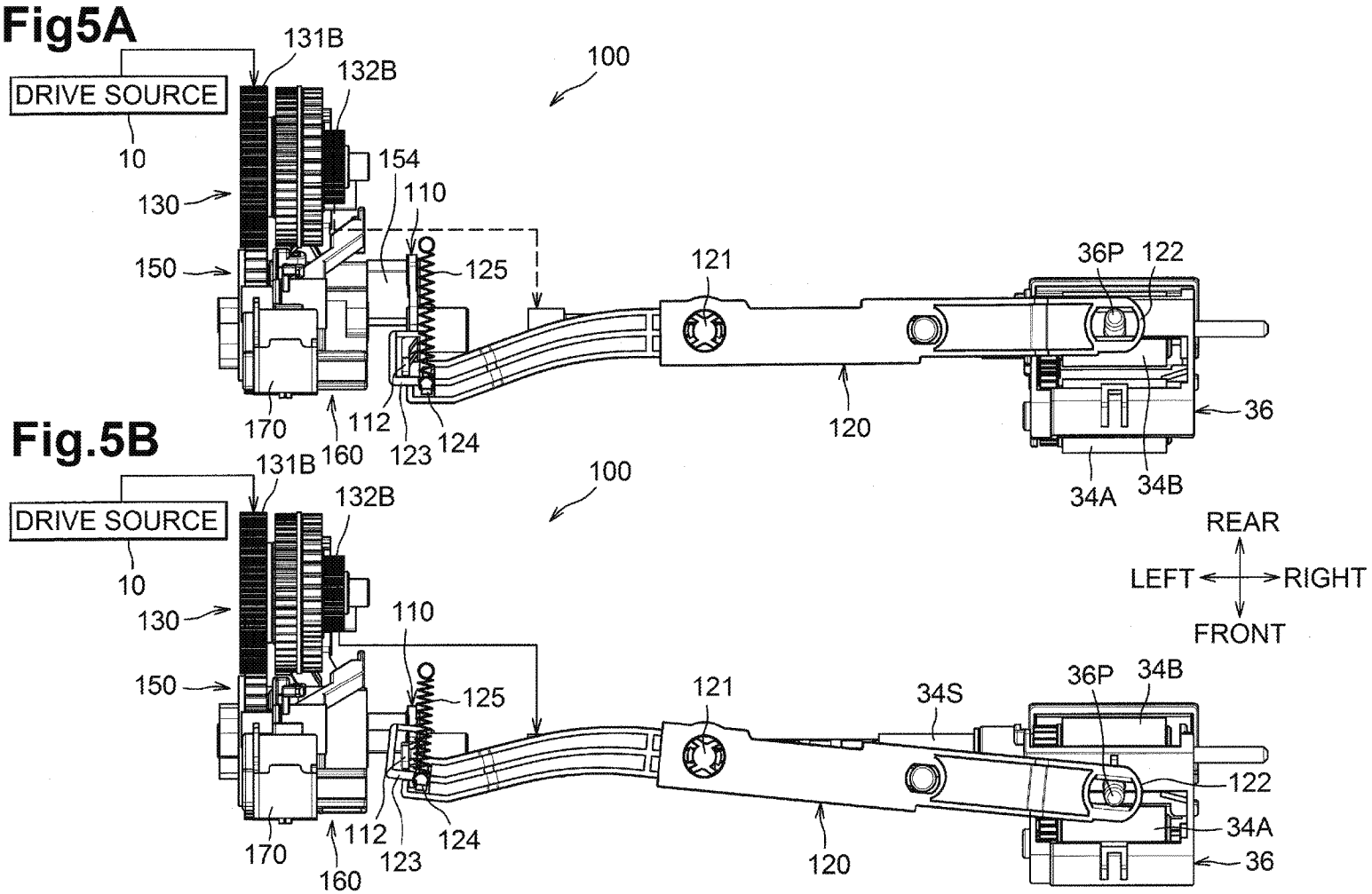
FIG. 5A is a plan view of the drive mechanism and the holder located in the second position.
FIG. 5B is a plan view of the drive mechanism and the holder located in the first position.

The link 120 is supported by the housing 2 such that the link 120 is pivotable about a shaft portion 121. As illustrated in FIGS. 5A and 5B, the link 120 is configured to pivot the holder 36 in response to pivoting of the holder pivoting member 110. The link 120 has a holder engaging portion 122 formed at a right end of the link 120. The holder engaging portion 122 engages a protruding portion 36P of the holder 36. The link 120 has a pivoting-member engaging portion 123 formed at a left end of the link 120. The pivoting-member engaging portion 123 engages the upper arm 112 of the holder pivoting member 110. The holder engaging portion 122 engages the protruding portion 36P, the pivoting-member engaging portion 123 engages the upper arm 112, and thus the link 120 connects the holder 36 and the holder pivoting member 110.

The pivoting-member engaging portion 123 has a spring positioning portion 124, which engages the front end of the coil spring 125. The rear end of the coil spring 125, in a stretched state, engages a spring positioning portion (not illustrated) disposed in the housing 2. This configuration allows the coil spring 15 to urge the left end of the link 120 toward the rear.

Figure 6A:
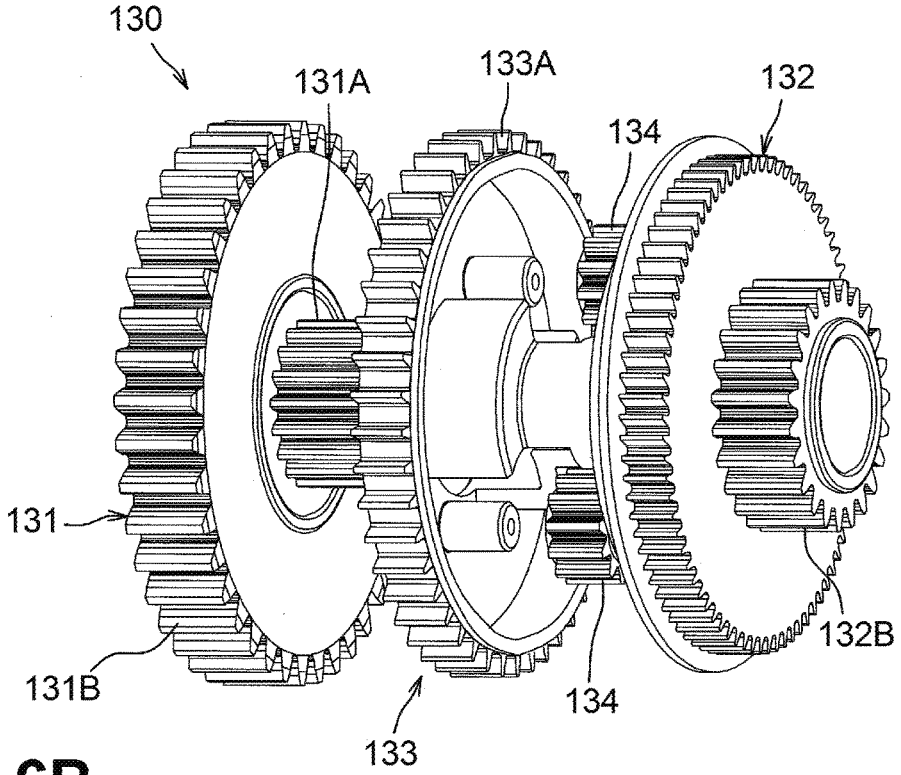
FIGS. 6A and 6B are exploded perspective views of a clutch gear assembly.
Figure 6B:
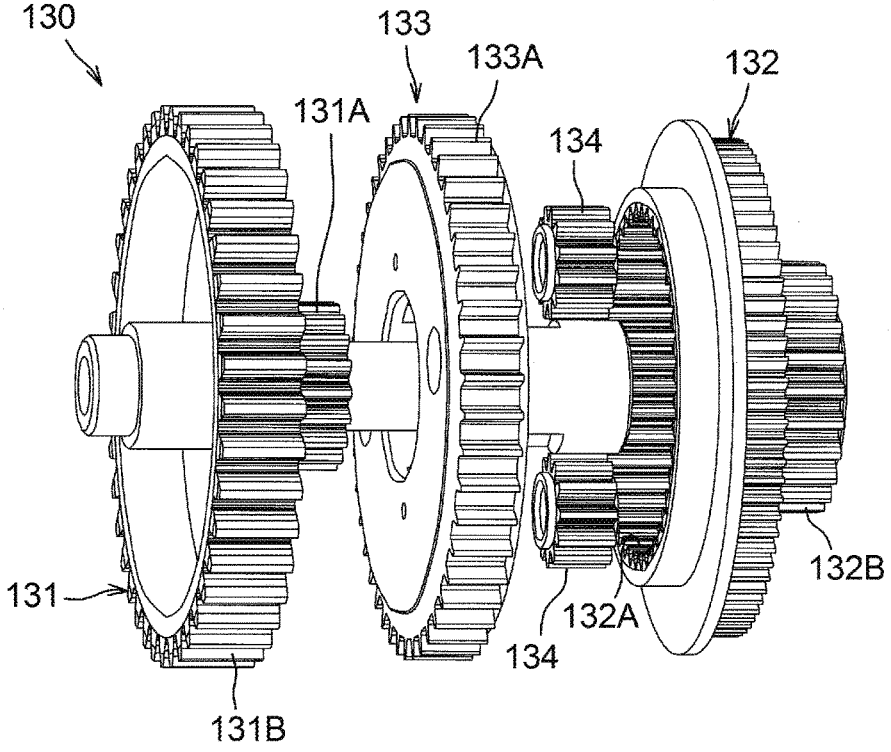

The clutch gear assembly 130 is a gear set configured to change between a cut-off state (FIG. 5A) that cuts off transmission of a driving force from the drive source 10 to the feed roller 34A and a transmission state (FIG. 5B) that allows transmission of the driving force from the drive source 10 to the feed roller 34A. As illustrated in FIGS. 6A and 6B, the clutch gear assembly 130 is a planetary gear mechanism including an input gear 131, an output gear 132, and a trigger member 133.

The input gear 131 has a sun gear 131A of the planetary gear mechanism at a central portion of the input gear 131 and external teeth 131B around the circumference of the input gear 131. The external teeth 131B are in mesh with an idle gear (not illustrated), to which a driving force is input from the drive source 10.

The output gear 132 has a ring gear 132A of the planetary gear mechanism on a surface facing the trigger member 133, and an output gear teeth 132B on an opposite surface. The output gear teeth 132B outputs the driving force to the separation roller 34B and the feed roller 34A via idle gears and separation roller drive gear, which are not illustrated.

The trigger member 133 corresponds to a carrier of the planetary gear mechanism and holds two planet gears 134. The trigger member 133 has trigger teeth 133A formed around the circumference of the trigger member 133. The trigger teeth 133A do not function as what is known as a gear. The trigger teeth 133A are configured to, when the clutch-state changing member 140 engages the trigger teeth 133A, allow the transmission of the driving force from the input gear 131 to the output gear 132 and configured to, when the clutch-state changing member 140 disengages from the trigger teeth 133A, cut off the transmission of the drive force from the input gear 131 to the output gear 132.

As illustrated in FIG. 4, the clutch-state changing member 140 is disposed at least partially below a portion of the clutch gear assembly 130 and is supported by the housing 2 such that it is pivotable about a shaft portion 141 extending in a direction parallel to the shaft portion 111. The clutch-state changing member 140 has a first arm 142 extending substantially frontward from the shaft portion 141 and a second arm 143 extending diagonally upward toward the front from the shaft portion 141. The first arm 142 has an end facing a second cam portion 156 of the rotator 150 and the second arm 143 has an end facing the circumference of the trigger member 133 illustrated in FIG. 6, that is, the trigger teeth 133A of the trigger member 133.

Returning to FIG. 4, the clutch-state changing member 140 has a spring engaging portion 144 formed below the shaft portion 141. A rear end of a coil spring 145 is in engagement with the spring engaging portion 144. A front end of the coil spring 145, in a stretched state, is in engagement with a spring engaging portion, which is not illustrated and disposed in the housing 2. This configuration allows the coil spring 145 to urge the clutch-state changing member 140 clockwise in FIG. 4.

Figure 9B:
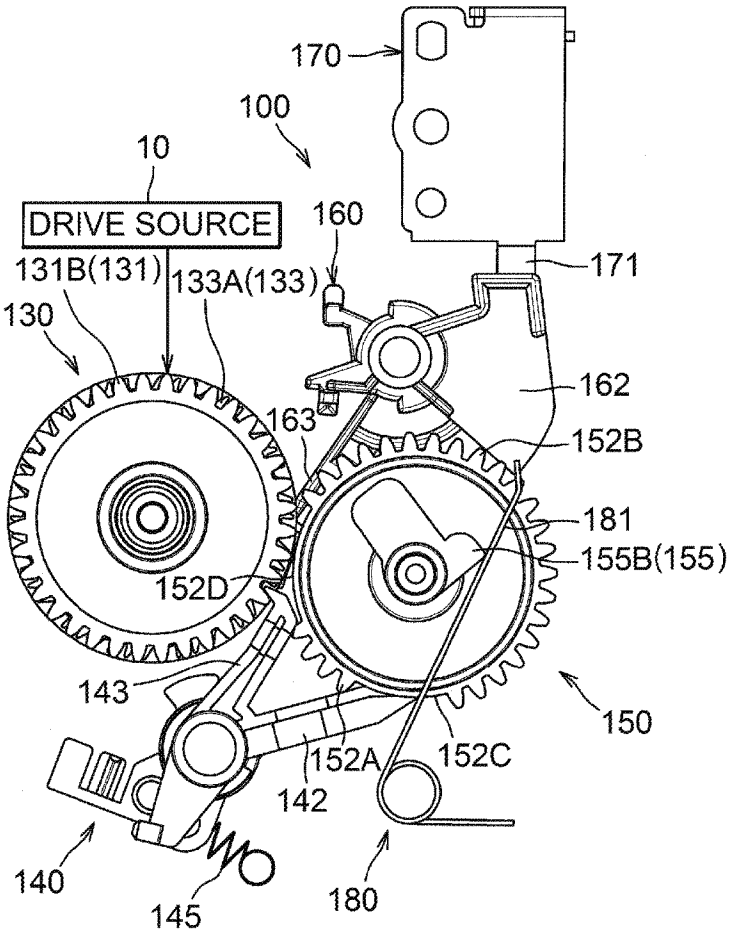
FIG. 9B is a left side view of the drive mechanism when the rotator is stopped at the ON position.

When the clutch-state changing member 140 pivots to move the end of the second arm 143 to engage the trigger teeth 133A of the clutch gear assembly 130, the clutch gear assembly 130 is put in the transmission state (FIG. 9B). When the clutch-state changing member 140 pivots to move the end of the second arm 143 to disengage from the trigger teeth 133A of the clutch gear assembly 130, the clutch gear assembly 130 is put in the cut-off state.

Figure 7A:
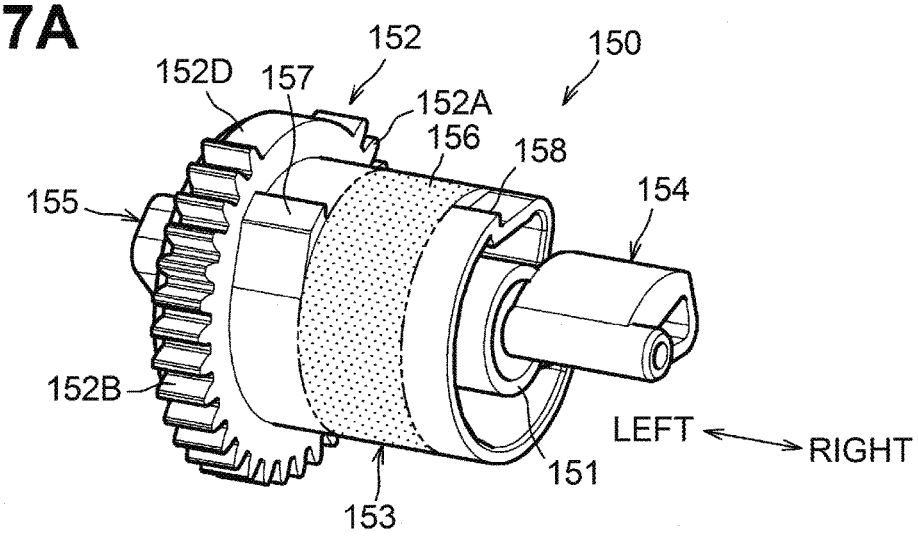
FIGS. 7A to 7C are perspective views of a rotator.
Figure 7B:
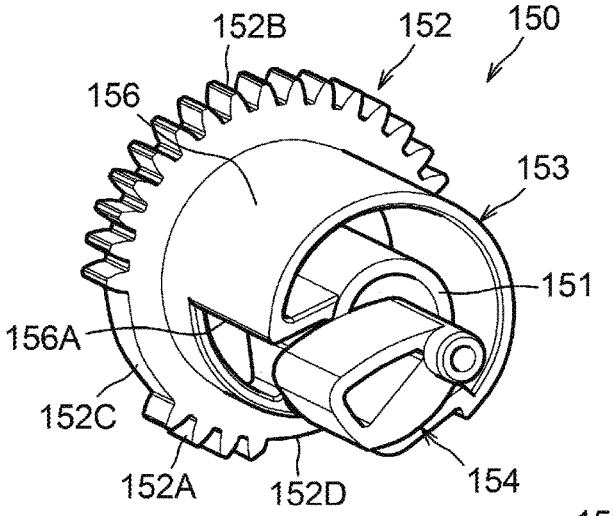
Figure 7C:
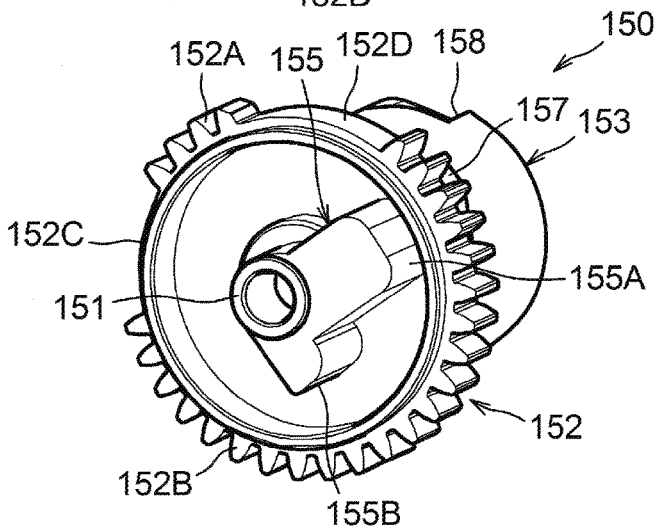

The rotator 150 is disposed in front of the clutch gear assembly 130 and supported by the housing 2 such that the rotator 150 is rotatable about a shaft portion 151 extending in a direction parallel to the shaft portion 141 of the clutch-state changing member 140. The rotator 150 includes a gear portion 152, a cylindrical portion 153, a first cam portion 154, and a third cam portion 155 (FIG. 7C). In the embodiment, the outer circumferential surface of the gear portion 152 corresponds to a second circumferential surface formed around a rotational axis of the rotator 150, and the outer circumferential surface of the cylindrical portion 153 corresponds to a first circumferential surface formed around the rotational axis of the rotator 150.

As illustrated in FIG. 7, the outer circumferential surface of the gear portion 152 includes a first gear toothed portion 152A and a second gear toothed portion 152B as an example of a gear toothed portion, a first toothless portion 152C, and a second toothless portion 152D.

The first gear toothed portion 152A and the second gear toothed portion 152B of the outer circumferential surface of the gear portion 152 are provided with gear teeth capable of meshing with the external teeth 131B of the input gear 131. When the first gear toothed portion 152A or the second gear toothed portion 152B engages the external teeth 131B, the rotation motion of the input gear 131 is transmitted to the rotator 150.

Figure 8B:
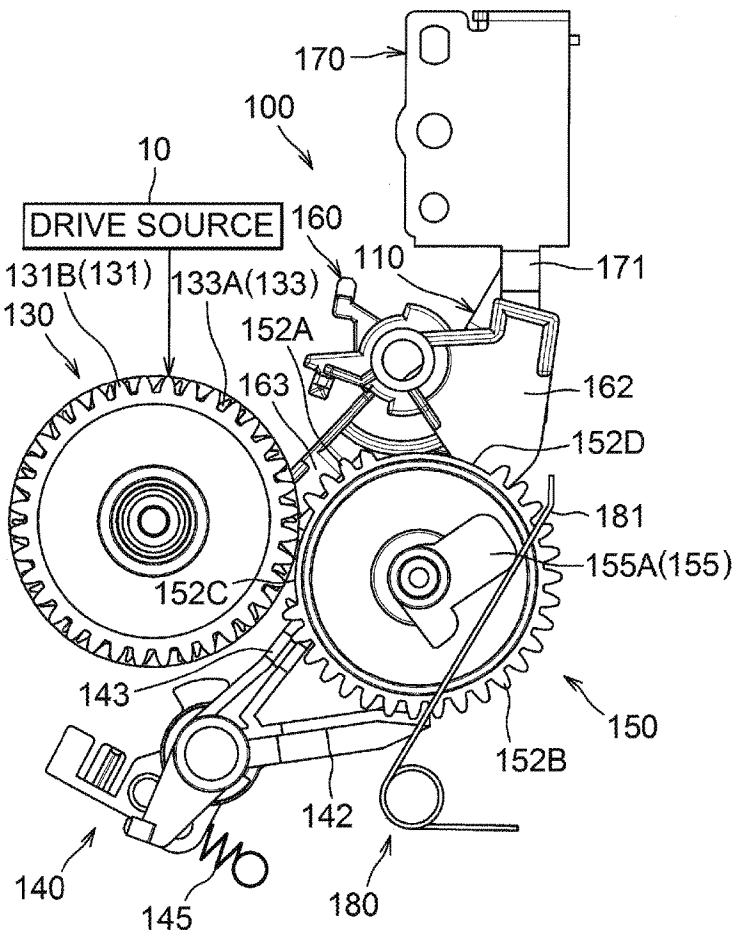
FIG. 8B is a left side view of the drive mechanism when the rotator is stopped at the OFF position.

The first toothless portion 152C and the second toothless portion 152D are portions of the outer circumferential surface of the gear portion 152 having no teeth formed thereon. As illustrated in FIG. 8B, when the first toothless portion 152C faces the external teeth 131B of the input gear 131, the rotator 150 is located at the OFF position where the clutch gear assembly 130 is put in the cut-off state. As illustrated in FIG. 9B, when the second toothless portion 152D faces the external teeth 131B of the input gear 131, the rotator 150 is located at the ON position where the clutch gear assembly 130 is put in the transmission state.

Returning to FIGS. 7A to 7C, the cylindrical portion 153 is shaped like a cylinder that protrudes from a side surface of the gear portion 152 and surrounds the shaft portion 151.

The outer circumferential surface of the cylindrical portion 153 contains a second cam portion 156, a protruding portion 157 as an example of a first engagement portion, and a stepped portion 158 as an example of a second engagement portion.

The second cam portion 156 is an area for pivoting the clutch-state changing member 140 and has a profile that a part of an outer cylindrical circumferential surface (a cam surface) is provided with a recessed portion 156A. The recessed portion 156A is provided at a position substantially aligned with the first toothless portion 152C in a circumferential direction of the rotator 150. As illustrated in FIG. 4, as the rotator 150 rotates, the end of the first arm 142 of the clutch-state changing member 140 slides on the outer cylindrical circumferential surface of the second cam portion 156 and enters the recessed portion 156A.

The protruding portion 157 is engageable with an end portion of a first engaging portion 162 of the stopper 160, and the stepped portion 158 is engageable with an end portion of a second engaging portion 163 of the stopper 160. As illustrated in FIG. 7A, in the circumferential direction of the rotator 150, the stepped portion 158 is provided at a position substantially aligned with the second toothless portion 152D, and the protruding portion 157 is provided at a position slightly shifted toward the second gear toothed portion 152B relative to the stepped portion 158.

The protruding portion 157 is disposed to the left of the second cam portion 156 (hatched area) to which the end of the first arm 142 faces. The stepped portion 158 is disposed to the right of the second cam portion 156. In other words, the protruding portion 157, the second cam portion 156, and the stepped portion 158 are shifted to one another in a left-right direction corresponding to a rotational axial direction of the rotator 150. Thus, the end of the first arm 142 does not engage the protruding portion 157 and the stepped portion 158.

The first cam portion 154 is an area for pivoting the holder pivoting member 110 and has a substantially egg-shaped profile as a whole. The first cam portion 154 protrudes from the shaft portion 151, in a radial direction of the shaft portion 151, toward the recessed portion 156A. The first cam portion 154 is disposed to the right of the cylindrical portion 153. Thus, the first cam portion 154 and the second cam portion 156 are shifted to each other in the left-right direction. As illustrated in FIG. 4, the lower arm 113 of the holder pivoting member 110 is configured to contact the first cam portion 154.

As illustrated in FIG. 7C, the third cam portion 155 has a substantially L-shaped profile as a whole. An arm 181 of a torsion spring 180 comes in contact with the third cam portion 155. Specifically, the third cam portion 155 has a first extension portion 155A extending from the shaft portion 151 toward the protruding portion 157 and a second extension portion 155B extending from the shaft portion 151 toward an opposite side to the first gear toothed portion 152A.

As illustrated in FIGS. 8B and 9B, the torsion spring 180 is configured to, when the external teeth 131B of the input gear 131 are not in mesh with the first gear toothed portion 152A or the second gear toothed portion 152B, apply a rotational force to the rotator 150. Specifically, as illustrated in FIG. 8B, when the first toothless portion 152C faces the external teeth 131B, the arm 181 of the torsion spring 180 presses the first extension portion 155A, thereby applying a rotational force to the rotator 150. As illustrated in FIG. 9B, when the second toothless portion 152D faces the external teeth 131B, the arm 181 of the torsion spring 180 presses the second extension portion 155B, thereby applying a rotational force to the rotator 150.

Figure 8A:
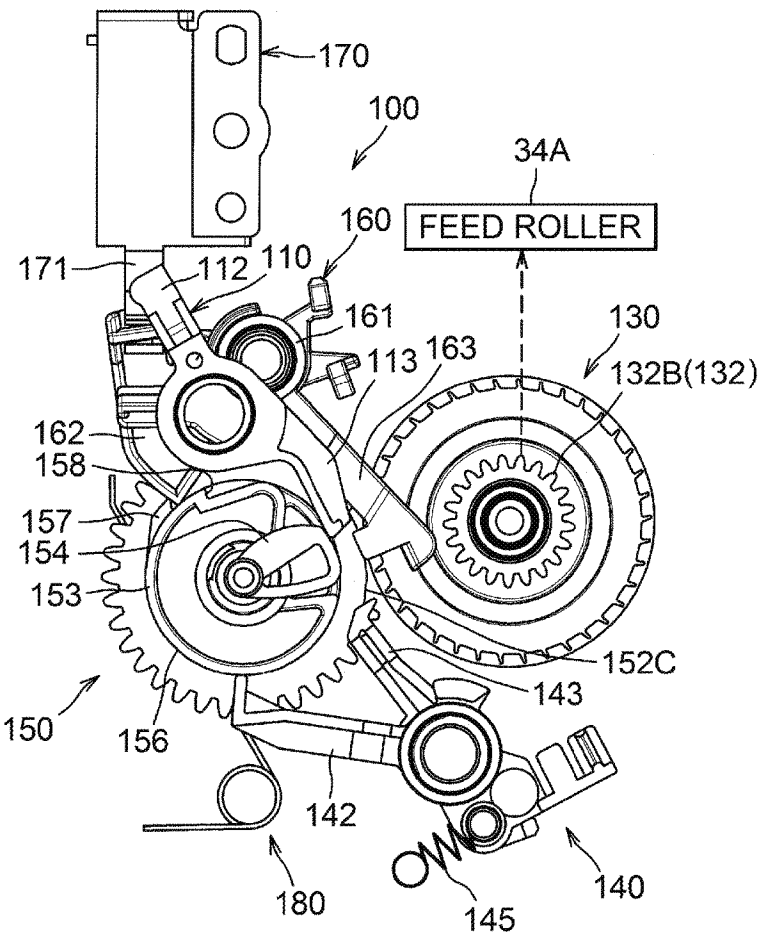
FIG. 8A is a right side view of the drive mechanism when the rotator is stopped at an OFF position.
Figure 9A:
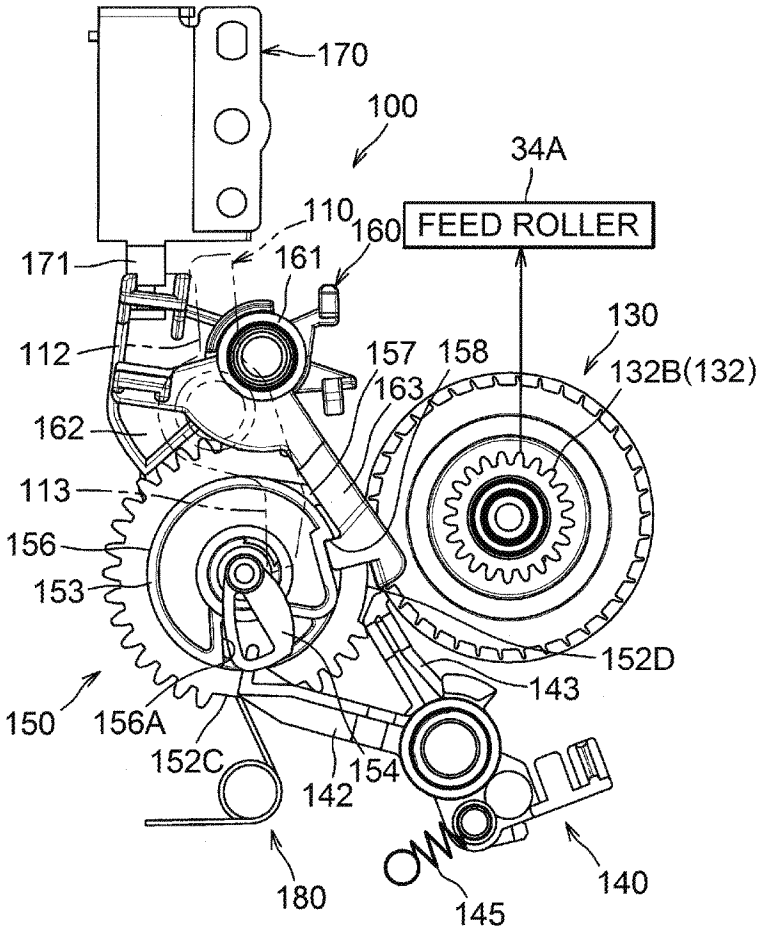
FIG. 9A is a right side view of the drive mechanism when the rotator is stopped at an ON position.

As illustrated in FIG. 9A, the stopper 160 is disposed at least partially above a portion of the rotator 150 and is supported by the housing 2 such that the stopper 160 is pivotable about a shaft portion 161 extending in a direction parallel to the shaft portion 111. Specifically, the stopper 160 has a first engaging portion 162 disposed in the front of the shaft portion 161 and a second engaging portion 163 extending diagonally downward to the rear from the shaft portion 161. The stopper 160 is pivotable between a position (FIG. 8A) where an end of the first engaging portion 162 engages the protruding portion 157 of the rotator 150 and a position (FIG. 9A) where an end of the second engaging portion 163 engages the stepped portion 158 of the rotator 150.

When the end of the first engaging portion 162 engages the protruding portion 157 of the rotator 150, the stopper 160 restricts the rotation of the rotator 150, and thus the rotator 150 is stopped at the OFF position illustrated in FIGS. 8A and 8B. When the end of the second engaging portion 163 engages the stepped portion 158 of the rotator 150, the stopper 160 restricts the rotation of the rotator 150, and thus the rotator 150 is stopped at the ON position illustrated in FIGS. 9A and 9B.

The actuator 170 is a device for moving or pivoting the stopper 160 to change the orientation of the stopper 160. In the embodiment, the actuator 17 is a solenoid actuator. The actuator 170 is disposed above the first engaging portion 162 of the stopper 160 and has a movable core 171 whose lower end portion is connected to an upper end portion of the first engaging portion 162. When a coil (not illustrated) is energized and the actuator 170 is turned on, the movable core 171 slides upward to raise the first engaging portion 162. When the coil is de-energized and the actuator 170 is turned off, the movable core 171 slides downward to lower the first engaging portion 162.

The following will describe operation of the drive mechanism 100.

As illustrated in FIGS. 8A and 8B, when the end of the first engaging portion 162 of the stopper 160 engages the protruding portion 157 of the rotator 150 and the rotator 150 is stopped at the OFF position, the drive mechanism 100 maintains the holder 36 at the second position where the feed roller 34A is separated from a sheet S supported on the MP tray 33 (FIG. 2) and does not transmit a driving force from the drive source 10 to the feed roller 34A.

Specifically, when the rotator 150 is at the OFF position, the lower arm 113 of the holder pivoting member 110 is in contact with the first cam portion 154 and thus the upper arm 112 of the holder pivoting member 110 is inclined toward the front side. Thus, as illustrated in FIG. 2, the left end of the link 120, at which the upper arm 112 engages the pivoting-member engaging portion 123, is located at a position pivoted toward the front against the urging force of the coil spring 125. The right end of the link 120 having the holder engaging portion 122 is located at a position pivoted toward the rear. The holder 36 is restricted from pivoting toward the front by engagement of the protruding portion 36P and the holder engaging portion 122 and is maintained at the second position where the feed roller 34A is separated from a sheet S on the MP tray 33.

As illustrated in FIGS. 8A and 8B, when the rotator 150 is at the OFF position, the clutch-state changing member 140 disengages from the trigger teeth 133A as the end of the first arm 142 of the clutch-state changing member 140 is in contact with the second cam portion 156 and the end of the second arm 143 is separated from the circumference of the trigger member 133. At this time, a driving force is transmitted from the drive source 10 to the external teeth 131B of the input gear 131 and the sun gear 131A (FIG. 6A) rotates. The planetary gears 134 revolve around the sun gear 131A and thus the trigger member 133 rotates. However, as the driving force is not transmitted to the output gear 132, the feed roller 34A does not rotate.

As illustrated in FIGS. 9A and 9B, when the driving force is transmitted from the drive source 10 to the external teeth 131B of the input gear 131 and the actuator 170 is turned on, the movable core 171 slides upward and raises the first engaging portion 162 of the stopper 160. The stopper 160 pivots, the end of the first engaging portion 162 is disengaged from the protruding portion 157 of the rotator 150, the restriction on the rotation of the rotator 150 is released and the end of the second engaging portion 163 comes in contact with the circumferential surface of the cylindrical portion 153.

As the restriction on the rotation of the rotator 150 is released, the rotator 150 starts to rotate due to the urging force of the torsion spring 180. As the first gear toothed portion 152A and the external teeth 131B of the input gear 131 mesh with each other, the driving force from the drive source 10 causes the rotator 150 to rotate. When the second toothless portion 152D faces the external teeth 131B of the input gear 131, the end of the second engaging portion 163, which has been sliding on the outer circumferential surface of the cylindrical portion 153, engages the stepped portion 158, thereby restricting the rotation of the rotator 150 to stop the rotator 150 at the ON position.

When the rotator 150 rotates from the OFF position to the ON position, the first cam portion 154 disengages from the lower arm 113 of the holder pivoting member 110. Then, as illustrated in FIG. 3, the urging force of the coil spring 125 causes the upper arm 112 of the holder pivoting member 110 and the left end of the link 120 to pivot to the rear, and causes the right end of the link 120 to pivots to the front. As a result, the holder 36 moves from the second position to the first position by engagement of the protruding portion 36P and the holder engaging portion 122 and the feed roller 34A comes in contact with a sheet S on the MP tray 33.

As illustrated in FIGS. 9A and 9B, when the rotator 150 rotates from the OFF position to the ON position, the end of the first arm 142 of the clutch-state changing member 140, which has been sliding on the second cam portion 156, faces the recessed portion 156A. The urging force of the coil spring 145 causes the clutch-state changing member 140 to pivot, so that the end of the first arm 142 enters the recessed portion 156A and the end of the second arm 143 engages the trigger teeth 133A of the trigger member 133. When the end of the second arm 143 engages the trigger teeth 133A, the rotation of the trigger member 133 (or the revolution of the planetary gears 134 around the sun gear 131A) is restricted and the clutch gear assembly 130 is put in the transmission state.

The rotation of the sun gear 131A is transmitted to the link gear 132A via the planetary gears 134, and the driving force from the drive source 10 is transmitted to the output gear 132. As a result, the driving force from the drive source 10 is transmitted, via the separation roller shaft 34S, to the separation roller 34B and the feed roller 34A, which are caused to rotate to feed a sheet S on the MP tray 33.

When the rotator 150 is stopped at the ON position, the drive mechanism 100 maintains the holder 36 at the first position where the feed roller 34A is brought in contact with a sheet S supported on the MP tray 33 and transmits the driving force from the drive source 10 to the feed roller 34A.

Figure 10B:
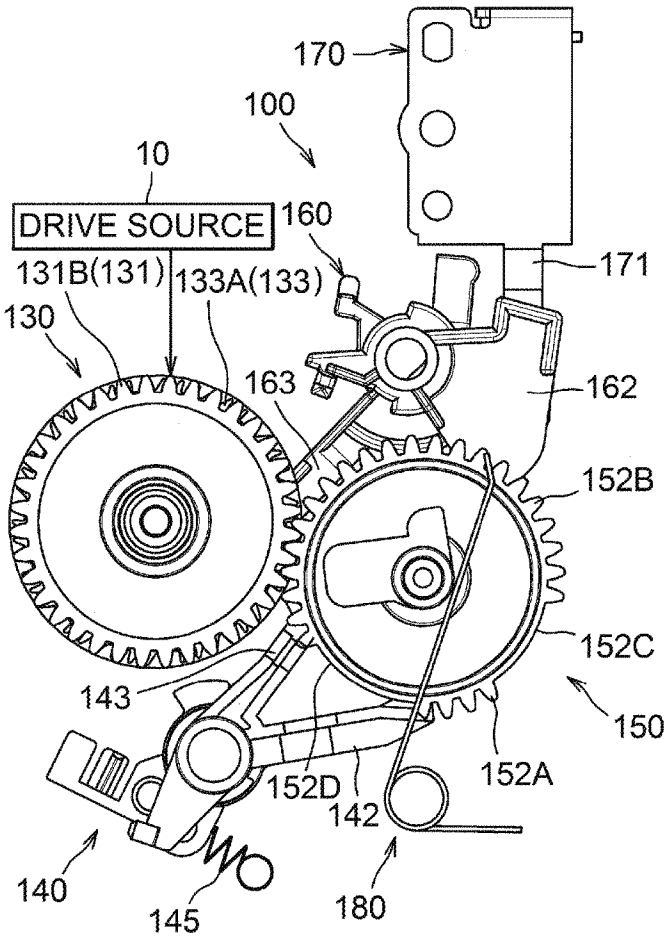
FIG. 10B is a left side view of the drive mechanism when the rotator is changed from the ON position to the OFF position.
Figure 10A:
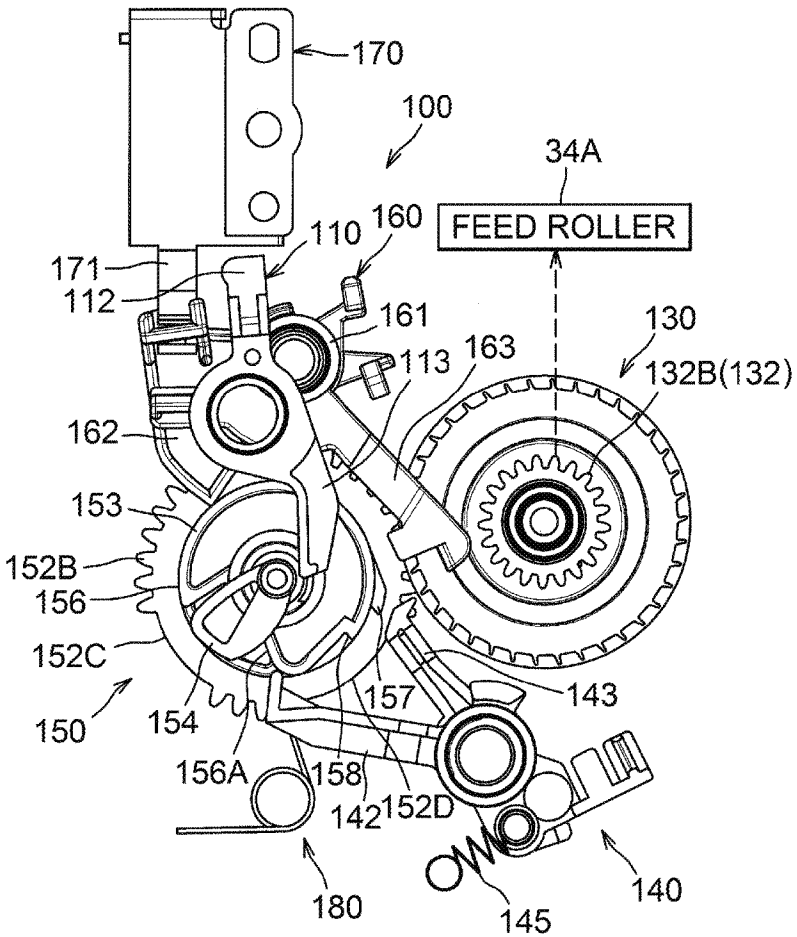
FIG. 10A is a right side view of the drive mechanism when the rotator is changed from the ON position to the OFF position.

As illustrated in FIGS. 10A and 10B, when the actuator 170 is turned off, the movable core 171 slides downward and pushes the first engaging portion 162 of the stopper 160 downward. Then, the stopper 160 pivots, the end of the first engaging portion 162 comes in contact with the outer circumferential surface of the cylindrical portion 153 of the rotator 150, the end of the second engaging portion 163 disengages from the stepped portion 158, and the restriction on the rotation of the rotator 150 is released.

As the restriction on the rotation of the rotator 150 is released, the rotator 150 starts to rotate due to the urging force of the torsion spring 180. As the second gear toothed portion 152B and the external teeth 131B of the input gear 131 mesh with each other, the driving force from the drive source 10 causes the rotator 150 to rotate.

Then, as the end of the first arm 142 of the clutch-state changing member 140 is pressed by an inclined surface of the recessed portion 156A of the second cam 156, the clutch-state changing member 140 pivots and the end of the second arm 143 disengages from the trigger teeth 133A of the trigger member 133. When the end of the second arm 143 disengages from the trigger teeth 133A, restriction on the rotation of the trigger member 133 is released and the clutch gear assembly 130 is put in the cut-off state. As the driving force from the drive source 10 is not transmitted to the output gear 132, the separation roller 34B and the feed roller 34A stop rotating due to the friction against the sheet S.

Then, when the rotator 150 further rotates, the first cam portion 154 comes in contact with the lower arm 113 of the holder pivoting ember 110, which causes the lower arm 113 to pivot to the rear and the upper arm 12 to pivot 112 to the front. Thus, as illustrated in FIG. 2, as the pivoting-member engaging portion 123 formed at the left end of the link 120 is pressed by the upper arm 112, the left end of the link 120 pivots toward the front against the urging force of the coil spring 125, and the right end of the link 120 pivots toward the rear. As a result, as the protruding portion 36P is pressed toward the rear by the holder engaging portion 122, the holder 36 moves from the first position to the second position and the feed roller 34A is separated from a sheet S on the MP tray 33.

Then, as illustrated in FIGS. 8A and 8B, the end of the first engaging portion 162, which has been sliding on the cylindrical portion 153 of the rotator 150, engages the protruding portion 157, thereby restricting the rotation of the rotator 150 to stop the rotator 150 at the OFF position.

When the rotator 150 is stopped at the OFF position, the drive mechanism 100 maintains the holder 36 at the second position where the feed roller 34A is separated from a sheet S supported on the MP tray 33 and does not transmit the driving force from the drive source 10 to the feed roller 34A.

According to the above-described embodiment, the actuator 170 causes the stopper 160 to pivot to a position where the end of the second engaging portion 163 is capable of engaging the stepped portion 158 of the rotator 150. When the end of the second engaging portion 163 engages the stepped portion 158, the rotator 150 is stopped at the ON position, at which the feed roller 34A is brought in contact with a sheet S on the MP tray 33 and is driven to rotate. The actuator 170 causes the stopper 160 to pivot to a position where the end of the first engaging portion 162 is capable of engaging the protruding portion 157 of the rotator 150. When the end of the second engaging portion 162 engages the protruding portion 157, the rotator 150 is stopped at the OFF position, at which the feed roller 34A is separated from a sheet S on the MP tray 33 and stops rotating. In other words, the laser printer 1 enables, through turning on and off of the actuator 170, the feed roller 34A to change between a state where the feed roller 34A contacts a sheet and is driven to rotate and a state where the feed roller 34A is separated from the sheet and stops rotating.

The outer circumferential surface of the cylindrical portion 153 contains the second cam portion 156, the protruding portion 157 as an example of a first engagement portion, and the stepped portion 158 as an example of a second engagement portion, which are shifted to one another in the left-right direction. The profile of the rotator 150 can be simplified compared with a case where the first engagement portion and the second engagement portion are disposed at a portion of the rotator 150 except for the cylindrical portion 153.

As the first cam portion 154 and the second cam portion 156 are shifted to each other in the left-right direction, the first cam portion 154 and the second cam portion 156 have structurally simple profiles.

The rotator 150 includes the first toothless portion 152C, which faces the input gear 131 when the rotator 150 is at the OFF position, and the second toothless portion 152C, which faces the input gear 131 when the rotator 150 is at the ON position. With such a relatively simple structure, the rotator 150 can be stopped at the OFF position and the ON position. There is provided the torsion spring 180 that applies a rotational force to the rotator 150 when the first toothless portion 152C or the second toothless portion 152D faces the input gear 131. When the restriction on the rotation of the rotator 150 is released, the rotator 150 can be caused to rotate to a position where the first gear teeth portion 152A or the second gear teeth portion 152B mesh with the input gear 131.

The driving mechanism 100 includes the link 120, which connects the holder pivoting member 110 and the holder 36 and pivots the holder 36 in response to pivoting of the holder pivoting member 110. The need for increasing the size and weight of the holder pivoting member 110 and the holder 36 can be minimized compared with a structure that the holder pivoting member and the holder are directly connected without use of a link.

While the disclosure has been described in detail with reference to the specific embodiment, it is to be understood that the disclosure is not limited thereto. Various changes, arrangements and modifications may be applied without departing from the spirit and scope of the disclosure.

The above embodiment shows, but is not limited to that the sun gear of the clutch gear assembly 130 (planetary gear mechanism) is used as the input gear, the ring gear as the output gear, and the carrier as the trigger member. For example, the sun gear may be used as the input gear, the carrier may be used as the output gear, and the ring gear may be used as the trigger member, or their combination may be varied. The above embodiment shows, but is not limited to that, the clutch mechanism is illustrated as the planetary gear mechanism. The clutch mechanism can be modified in any manner sufficient to switch between the transmission state that allows transmission of the driving force from the drive source to the roller and the cut-off state that cuts off transmission of the driving force from the drive source to the roller.

The above embodiment shows, but is not limited to that, the actuator 170 is a solenoid actuator. The actuator may have any operating principle and structure sufficient to change the position of the stopper.

The above embodiment shows, but is not limited to that, the second cam portion 156, the protruding portion 157 as an example of the first engagement portion, and the stepped portion 158 as an example of the second engagement portion are arranged in a limited area of the outer circumferential surface, as an example of the first circumferential surface, of the cylindrical portion 153 of the rotator 150, in the circumferential direction. For example, the second cam portion, the first engagement portion, and the second engagement portion may be disposed at different areas on the rotator in the circumferential direction.

The above embodiment shows, but is not limited to that, the drive mechanism 100 includes the link 120 connecting the holder pivoting member 110 and the holder 36 and configured to pivot the holder 36 in response to pivoting of the holder pivoting member 110. For example, the link may be omitted from the drive mechanism 100, and the holder pivoting member and the holder may be directly connected to each other such that the holder pivoting member directly pivots the holder.

The above embodiment illustrates, but is not limited to, the MP tray 33 as a support portion, and the feed roller 34A of the second sheet feeding mechanism 34 as a roller. For example, the support portion may be configured as the sheet tray 31, and the roller may be configured as the feed roller 32A of the first sheet feeding mechanism 32. In addition, the roller is not limited to the feed roller. The roller may be a separation roller.

The above embodiment shows, but is not limited to, that the holder 36 holds the feed roller 34A, and is pivotable between the first position where the feed roller 34A is located at the roller contact position and the second position where the feed roller 34A is located at the roller separation position. For example, the holder may hold a separation pad and be pivotable between a first position where the separation pad is located at a separation-member contact position where the separation pad is pressed against a sheet S fed from a MP tray and a second position where the separation pad is located at a separation-member separate position where the separation pad is moved in a direction away from the sheet S from the first position. The separation-member separate position may be a position where the separation pad is completely separated from a sheet or a position where the separation pad is not completely separated from the sheet. When the separation pad is not completely separated from the sheet, for example, the separation pad may contact the sheet but the feeding resistance may be weaker at the separation-member separate position than that at the separation-member contact position.

The above embodiment shows, but is not limited to, as an example of the separation member, the separation pad 34C that applies a frictional resistance to a sheet S. For example, the separation member may be configured to apply a feeding resistance to sheets through the use of a step height to feed each sheet such that the feeding resistance causes a first sheet only to move over the separation member.

The above embodiment shows, but is not limited to, the laser printer 1 configured to from a monochrome image on a sheet S as an example of an image forming apparatus to which the disclosure is applied. The image forming apparatus may include a printer configured to form a color image on a sheet S. The image forming apparatus is not limited to an electrophotographic printer, e.g., a laser printer. The image forming apparatus may be other type printers such as an ink-jet type printer and a thermal printer. Further, the image forming apparatus may be a copier and a multifunction apparatus which are each provided with a document reader, e.g., a flatbed scanner.

The above embodiment shows but is not limited to the sheet S. For example, the sheet may be a transparency.

What is claimed is:

1. An image forming apparatus comprising:

a support portion configured to support a sheet;

a roller configured to feed the sheet supported on the support portion;

a separation member configured to apply a feeding resistance to the sheet fed by the roller from the support portion;

a holder holding the roller and configured to pivot about a pivot axis between a first position where the roller contacts the sheet supported on the support portion and a second position where the roller is separated from the sheet supported on the support portion;

a holder pivoting member configured to pivot about a pivot axis parallel to the pivot axis of the holder and to pivot the holder between the first position and the second position;

a clutch mechanism configured to change between a transmission state that allows transmission of a driving force from a drive source to the roller and a cut-off state that cuts off the transmission of the driving force from the drive source to the roller;

a clutch-state changing member configured to pivot about a pivot axis parallel to the axis of the holder pivoting member to engage the clutch mechanism such that the clutch mechanism is at the transmission state and to disengage from the clutch mechanism such that the clutch mechanism is at the cut-off state;

a rotator including a first cam portion for pivoting the holder pivoting member and a second cam portion for pivoting the clutch-state changing member, the rotator being configured to rotate about a rotational axis parallel to the pivot axis of the clutch-state changing member between an off position where the first cam portion pivots the holder pivoting member to bring the holder to the second position and the second cam portion pivots the clutch switching mechanism to bring the clutch mechanism to the cut-off state and an on position where the first cam portion pivots the holder pivoting member to bring the holder to the first position and the second cam portion pivots the clutch-state changing member to bring the clutch mechanism to the transmission state;

a stopper including a first engaging portion and a second engaging portion, the first engaging portion and the second engaging portion extending in different, respective directions, the stopper being configured to pivot about a pivot axis parallel to the rotational axis of the rotator between a first engagement position where the first engaging portion engages the rotator and a second engagement position where the second engaging portion engages the rotator, the stopper being configured to, when the first engaging portion engages the rotator, stop the rotator at the off position, and configured to, when the second engaging portion engages the rotator, stop the rotator at the on position; and an actuator connected to the stopper and configured to move the stopper between the first engagement position and the second engagement position.

2. The image forming apparatus according to claim 1, wherein the rotator has a first circumferential surface formed around the rotational axis of the rotator, wherein the first circumferential surface contains the second cam portion, a first engagement portion, and a second engagement portion, which are shifted from one another in a direction where the rotational axis of the rotator extends, wherein the first engaging portion of the stopper is configured to engage the first engagement portion on the first circumferential surface, and wherein the second engaging portion of the stopper is configured to engage the second engagement portion on the first circumferential surface.

3. The image forming apparatus according to claim 1, wherein the first cam portion and the second cam portion of the rotator are shifted from each other in a direction where the rotational axis of the rotator extends.

4. The image forming apparatus according to claim 1, wherein:

the clutch mechanism includes a planetary gear mechanism having a sun gear, a carrier, a plurality of planetary gears, and a ring gear, one of the sun gear, the carrier, and the ring gear functions as an input gear to which the driving force from the drive source is inputted, another of the sun gear, the carrier, and the ring gear functions as an output gear which outputs the driving force to the roller, and the other of the sun gear, the carrier, and the ring gear functions as a trigger member configured to engage the clutch-state changing member.

5. The image forming apparatus according to claim 4, wherein the rotator has a second circumferential surface formed around the rotational axis of the rotator, wherein the second circumferential surface includes a gear toothed portion provided with gear teeth capable of meshing with the input gear, a first toothless portion facing the input gear when the rotator is at the off position, and a second toothless portion facing the input gear when the rotator is at the on position, and wherein the image forming apparatus further comprises an urging member configured to, when the input gear disengages from the gear toothed portion, apply a rotational force to the rotator.

6. The image forming apparatus according to claim 4, wherein the input gear is the sun gear, the output gear is the ring gear, and the trigger member is the carrier.

7. The image forming apparatus according to claim 1, further comprising a link connecting the holder pivoting member and the holder and configured to pivot the holder in response to pivoting of the holder pivoting member.

8. The image forming apparatus according to claim 1, further comprising a housing having an opening, wherein the support portion is movable between a closed position where the opening is closed and an open position where the opening is open, and wherein the support portion is configured to, when in the open position, support the sheet on an upper surface of the support portion.

9. The image forming apparatus according to claim 1, wherein the separation member includes a separation pad.

10. The image forming apparatus according to claim 1, wherein the roller includes a feed roller.

11. The image forming apparatus according to claim 1, wherein the clutch-state changing member is at least partially disposed below a portion of the clutch assembly.

* * * * *